US006227398B1

(12) United States Patent
Yang et al.

(10) Patent No.: US 6,227,398 B1
(45) Date of Patent: May 8, 2001

(54) COLLAPSIBLE HAMPER

(75) Inventors: Frank Yang, Palos Verdes Peninsula; William Tan, Glendale, both of CA (US)

(73) Assignee: Seville Classics, Los Angeles, CA (US)

( * ) Notice: Subject to any disclaimer, the term of this patent is extended or adjusted under 35 U.S.C. 154(b) by 0 days.

(21) Appl. No.: 09/483,575

(22) Filed: Jan. 14, 2000

(51) Int. Cl.[7] ..... B65F 1/06

(52) U.S. Cl. ..... 220/9.4; 220/4.33; 220/495.11; 220/4.04

(58) Field of Search ..... 220/908.1, 495.11, 220/495.08, 495.06, 62, 4.34, 4.04, 4.05, 4.08, 4.09, 4.1, 4.28, 4.33, 9.4

(56) References Cited

U.S. PATENT DOCUMENTS

| | | | | |
|---|---|---|---|---|
| 4,463,864 | * | 8/1984 | Roach | 220/4.34 |
| 5,072,828 | * | 12/1991 | Irvine | 220/4.33 |
| 5,560,508 | * | 10/1996 | Hsu | 220/4.31 |
| 5,695,986 | * | 12/1997 | Wold et al. | 435/290.1 |
| 5,702,001 | * | 12/1997 | Russell et al. | 206/388 |
| 5,743,422 | * | 4/1998 | Hale . | |

* cited by examiner

*Primary Examiner*—Stephen Castellano
(74) *Attorney, Agent, or Firm*—Raymond Sun

(57) ABSTRACT

A hamper assembly has a plurality of separate sections, and a plurality of supports. Each section has a first side and a second side, and a connector provided on each side of each section. In addition, each support removably couples the connector on the first side of one section and the connector on the second side of an adjacent section.

12 Claims, 2 Drawing Sheets

COLLAPSIBLE HAMPER

BACKGROUND OF THE INVENTION

1. Field of the Invention

The present invention relates to household items, and in particular, to a hamper that can be collapsed to a compact configuration for convenient storage and transportation.

2. Description of the Prior Art

Space, storage, convenience and shipping are major concerns relating to the shipment and sale of household items. For example, the bulkiness and large sizes of many of these household items can not only increase the shipping costs of such items, but can also present space and storage problems to consumers who live in smaller homes and apartments.

An example of such household items is laundry hampers. Laundry hampers tend to be large in size to hold a reasonable amount of dirty clothing. However, transportation and storage of these hampers is quite troublesome, since their large sizes and bulkiness makes it more costly to ship them from the manufacturer to retailers. In addition, the consumer often needs sufficient space in their vehicles to take them home, and then needs sufficient floor space in the home to store these hampers when they are not in use.

Thus, there remains a need for a laundry hamper that can be conveniently shipped, transported, stored and deployed for use, and which takes up minimal space, thereby decreasing the shipping costs and increasing convenience to the consumer.

SUMMARY OF THE DISCLOSURE

In order to accomplish the objects of the present invention, there is provided a hamper assembly that has a plurality of separate sections, and a plurality of supports. Each section has a first side and a second side, and a connector provided on each side of each section. In addition, each support removably couples the connector on the first side of one section and the connector on the second side of an adjacent section.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

The present invention provides hamper assemblies that can be collapsed to reduce bulk and size for more convenient storage and transportation. The hamper assemblies according to the present invention have a plurality of sections that are coupled together to form a frame. These sections can be detached and then placed on top of each other to provide a smaller profile and less bulk for storage and transportation.

FIGS. 1–5 illustrate one embodiment of the hamper assembly 10 of the present invention. The assembly 10 has a plurality of sections 12 and 14, and two pole supports 16 and 18 for connecting the sections 12 and 14 to form the assembly 10. Each section 12 and 14 can be made from a solid material, such as rattan, wicker, metal, plastic or similar materials.

Figure 4:
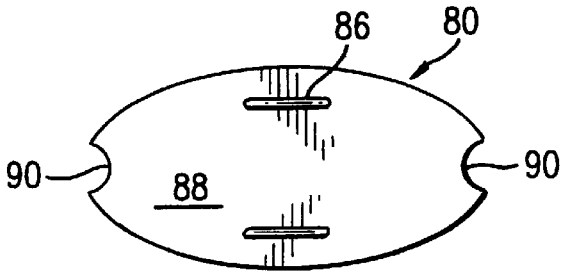
FIG. 4 is a bottom perspective view of the lid of FIG. 3.
Figure 5:
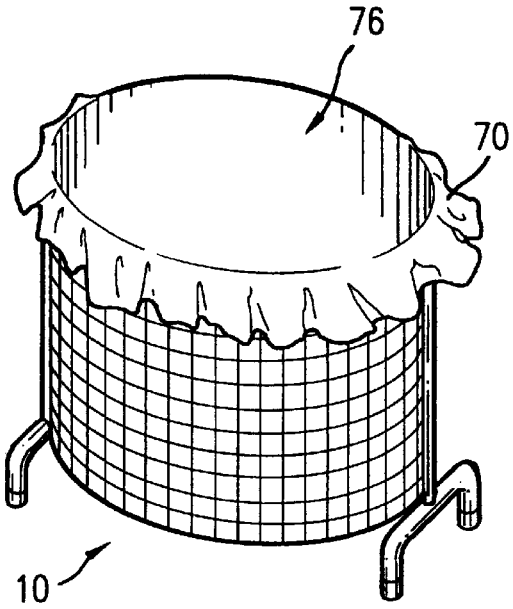
FIG. 5 is a perspective view of the assembly of FIG. 1 with a laundry bag deployed therein.
Figure 6:
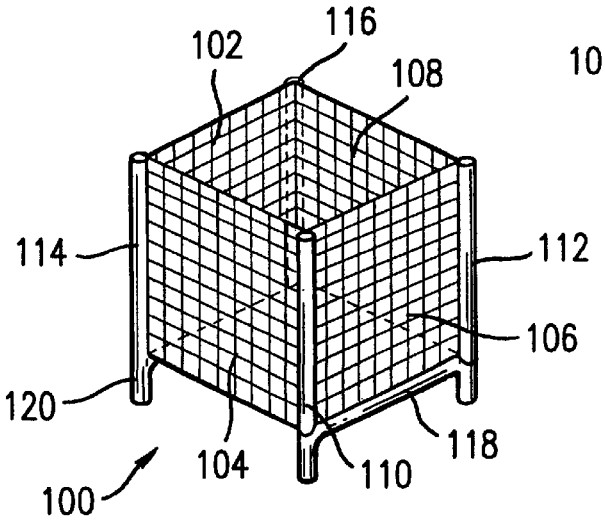
FIG. 6 is a perspective view of a hamper assembly according to another embodiment of the present invention.

In the embodiment of FIGS. 1–5, each section 12 and 14 can be curved or generally semi-circular in configuration, although other configurations can be used (such as illustrated in FIG. 6 below). Each section 12 and 14 has two sides 20, 22 and 24, 26, respectively. One or more aligning connectors can be provided in spaced-apart manner along each side 20, 22, 24, 26. For example, the side 20 of section 12 can have two connectors 30 and 32, the side 22 of section 12 can have two connectors 34 and 36, the side 24 of section 14 can have two connectors 38 and 40, and the side 26 of section 12 can have two connectors (not shown). Each connector 30, 32, 34, 36, 38, 40 can be a curved metal plate having an opening 42 provided in the center thereof, and with a shaft 44 connecting the curved metal plate to a side 20, 22, 24 or 26. Each metal plate is preferably concave in that the curvature extends radially inwardly towards the center of the corresponding section 12 or 14.

Each pole support 16 and 18 has a pole 50 and 52, respectively. Each pole 50 and 52 has a lower end that is connected (e.g., by welding or by a screw 54) to a leg 56 and 58, respectively. If a screw 54 is used to connect each leg 56, 58 to its pole 50, 52, then a threaded opening 60 can be provided in the leg 56, 58 and the lower end of each pole 50 and 52 can have a threaded bore (not shown), so that the screw 54 can be threaded through the opening 60 and secured inside the threaded bore.

Figure 1:
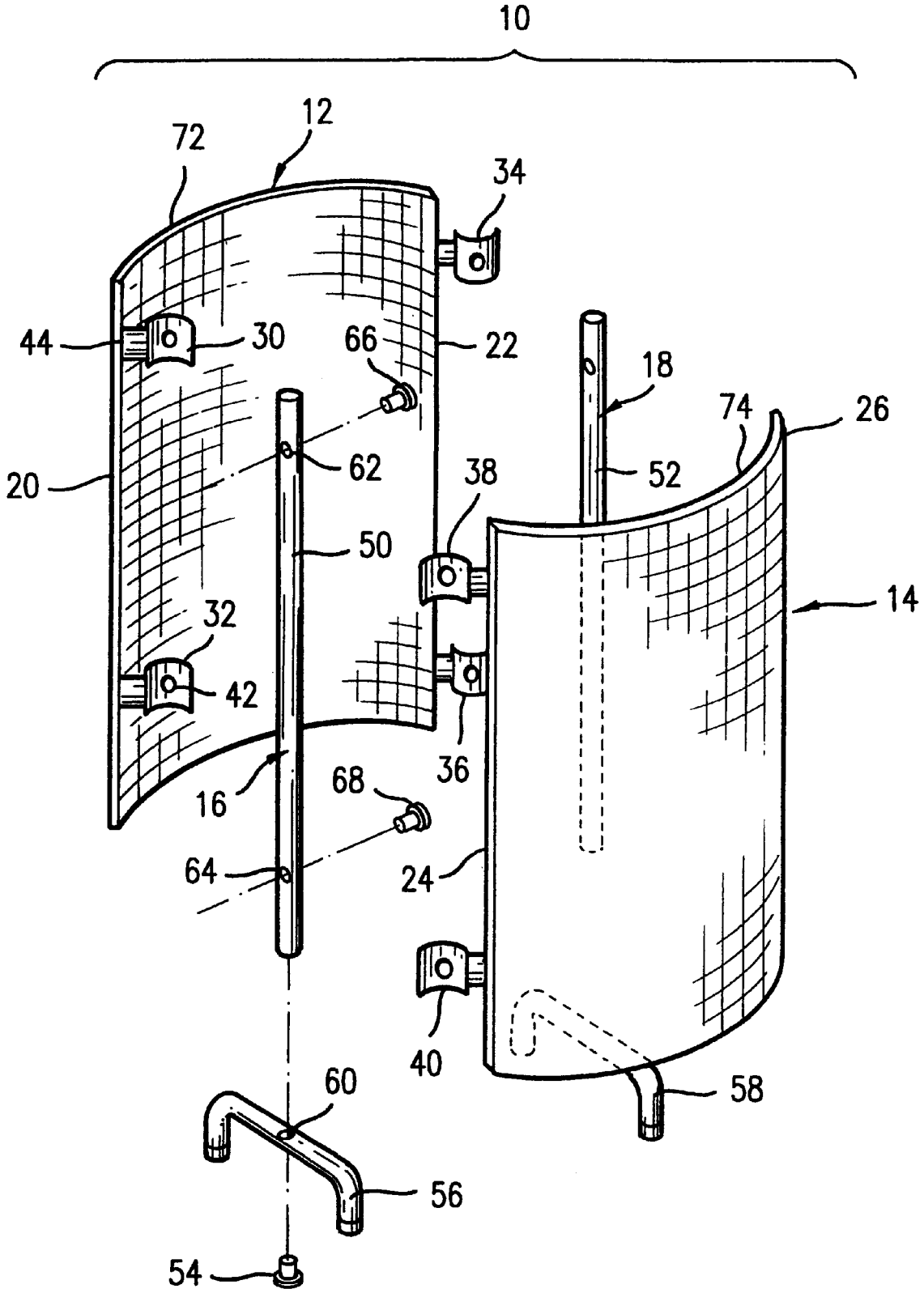
FIG. 1 is an exploded perspective view of a hamper assembly according to one embodiment of the present invention.
Figure 2:
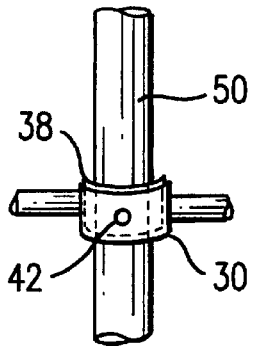
FIG. 2 is a sectional view of a pair of connectors of the assembly of FIG. 1.

The assembly 10 is shown in FIG. 1 with its components disassembled, and can be assembled in the following manner. The sections 12 and 14 can be positioned with the sides 20 and 24 adjacent to each other, and the sides 22 and 26 adjacent to each other. When so positioned, the connectors 30 and 38 on sides 20 and 24, respectively, and the connectors 32 and 40, will be positioned adjacent each other with their openings 42 aligned. Similarly, the connectors 34 and 36 on the side 22 will be aligned with the connectors on the side 26. The pole 50 is then placed into the concave region defined by the pairs of aligned connectors 30+38 and 32+40. FIG. 2 illustrates the alignment of connectors 30 and 38, as viewed from the center of the internal space defined by the sections 12 and 14. The pole 50 has two threaded openings 62 and 64 that are adapted to be aligned with the aligned connectors 30+38 and 32+40, respectively. One screw 66 can then be inserted from the internal space through the aligned openings 42 (for connectors 30 and 38) and 62, and another screw 68 can then be inserted from the internal space through the aligned openings 42 (for connectors 32 and 40) and 64, to secure the sides 20 and 24 to the pole 50. The other pole 52 can be secured to the other sides 22 and 26 in the same manner. Thus, the assembly 10 is complete and ready for use.

When the components of the assembly 10 are disassembled, the sections 12 and 14 can be placed one on top of the other, in a nested fashion, and the poles 50, 52 placed in the concave region of the sections 12, 14. This provides a slim profile (i.e., two stacked sections 12, 14) that will occupy less space for shipping, packing, storage and transportation.

Although FIG. 1 illustrates the use of two sets of connectors for each side of a section 12, 14, it is possible to provide any number of connectors for each side.

Figure 3:
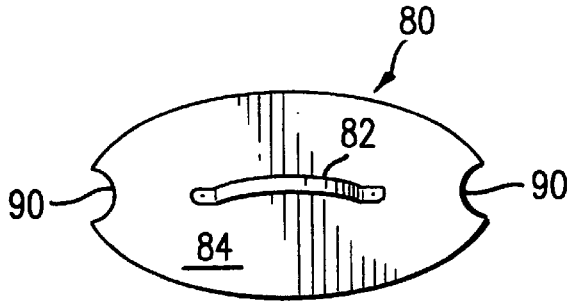
FIG. 3 is a top perspective view of a lid that can be used with the assembly of FIG. 1.

When the assembly 10 is assembled in the manner illustrated above, the assembly 10 can act as a frame for supporting a laundry bag. Referring to FIG. 5, any conventional fabric or plastic laundry bag 70 can be draped over the top edges 72 and 74 of the sections 12 and 14, respectively, with its opening 76 exposed to the top of the assembly 10. A separate lid 80 can be placed over the top of the assembly 10 to cover the laundry bag 70. The lid 80 is illustrated in FIGS. 3 and 4, and can be a flat plate having a handle 82 secured to a top surface 84, and a pair of bars 86 positioned on a bottom surface 88. The bars 86 are positioned to be adjacent the sections 12 and 14 when the lid 80 is positioned over the assembly 10, and functions to help the user align the lid 80 to the top of the assembly 10. The lid 80 has a shape that preferably corresponds to the shape of the opening 76. An optional pair of indents 90 can be provided on either end of the lid 80 to accomodate the poles 50 and 52, if necessary.

Although FIG. 1 illustrates two curved sections 12 and 14, it is also possible to provide the assembly 10 with any number of sections, and with each section being flat. For example, FIG. 6 illustrates another assembly 100 having four separate flat sections 102, 104, 106, 108 that are connected to four separate poles 110, 112, 114, 116. Two poles 110 and 112 can be connected to one leg 118, and the other two poles can be connected to another leg 120. The sections 102, 104, 106, 108 and poles 110, 112, 114, 116 can be assembled in the same manner as illustrated above for the assembly 10.

Those skilled in the art will appreciate that the embodiments and alternatives described above are non-limiting examples only, and that certain modifications can be made without departing from the spirit and scope thereof. The accompanying claims are intended to cover such modifications as would fall within the true scope and spirit of the present invention.

What is claimed is:

1. A hamper assembly, comprising:

a plurality of separate sections, each section having a first side and a second side, and a connector provided on each side of each section, each connector having a curved plate that has an opening; and a plurality of supports, each support removably coupling the connector on the first side of one section and the connector on the second side of an adjacent section.

2. The assembly of claim 1, wherein each support further includes a leg.

3. The assembly of claim 1, wherein each support is a pole having a threaded opening.

4. The assembly of claim 3, further including a screw inserted through the threaded opening and the openings of the connector on the first side of one section and the connector on the second side of an adjacent section.

5. The assembly of claim 1, wherein the plurality of sections defines a top opening, and the assembly further includes a laundry bag suspended over the top opening.

6. The assembly of claim 5, further including a lid for covering the laundry bag.

7. The assembly of claim 6, wherein the lid has a bottom surface having a pair of side bars.

8. The assembly of claim 1, wherein each section is curved.

9. The assembly of claim 1, wherein each section is flat.

10. The assembly of claim 1, wherein there are two sections.

11. The assembly of claim 1, wherein there are four sections.

12. The assembly of claim 1, wherein each section is made of a solid material.

* * * * *